US006228507B1

(12) United States Patent
Hahn

(10) Patent No.: US 6,228,507 B1
(45) Date of Patent: May 8, 2001

(54) ORNAMENTAL PLASTER CROWN MOLDING

(76) Inventor: Richard D. W. Hahn, 1034 Capen Ave., Diamond Bar, CA (US) 91789

( * ) Notice: Subject to any disclaimer, the term of this patent is extended or adjusted under 35 U.S.C. 154(b) by 0 days.

(21) Appl. No.: 09/138,852

(22) Filed: Aug. 24, 1998

(51) Int. Cl.[7] ..... E04B 2/00; A47G 35/00

(52) U.S. Cl. ..... 428/542.2; 428/167; 428/172; 428/192; 428/213; 52/287.1; 442/386

(58) Field of Search ..... 52/255, 254, 287.1, 52/316, 742.1, 742.12, 717.01, 716.1, 311; 428/192, 167, 537.7; 442/367, 348, 386, 327

(56) References Cited

U.S. PATENT DOCUMENTS

| | | | | |
|---|---|---|---|---|
| 2,981,988 | | 5/1961 | Schweitzer | 20/74 |
| 3,201,910 | | 8/1965 | Keesee | 52/716 |
| 3,481,092 | | 12/1969 | Constantino | 52/288 |
| 3,940,528 | * | 2/1976 | Roberts | 161/160 |
| 4,144,372 | * | 3/1979 | Beck | 428/283 |
| 5,398,469 | | 3/1995 | Logan | 52/288.1 |
| 5,433,048 | | 7/1995 | Strasser | 52/288.1 |
| 5,662,753 | | 9/1997 | Loos | 156/71 |
| 5,819,485 | * | 10/1998 | Lane et al. | 52/287.1 |
| 5,918,435 | * | 7/1999 | Mcgowen | 52/311.1 |

* cited by examiner

*Primary Examiner*—Donald J. Loney

(57) ABSTRACT

A prefabricated crown molding strip designed to facilitate one-person installation and composed of plaster that is reinforced by two layers of fiber reinforcement, one of bulk fiberglass intermixed throughout the outer portion of the strip and the ornamentation thereon and a second of a sheet of fiberglass netting generally centrally located as a spine in the strip and substantially coextensive therewith. Two side surfaces of the strip are disposed generally in perpendicular planes for engagement with a wall and a ceiling, and have patterns of longitudinally extending ribs and grooves of predetermined depths for facilitating adhesive mounting of the strip, and also facilitating selective removal of plaster to accommodate irregularities on supporting surfaces. Preformed nail holes are molded in preselected nailing locations. Also the method of making crown molding strips in steps providing the above characteristics, in a sequence of pours of plaster in fluid state, the addition of the reinforcing fiber, and formation of the patterns of ribs and grooves.

25 Claims, 5 Drawing Sheets

ORNAMENTAL PLASTER CROWN MOLDING

FIELD OF THE INVENTION

This invention relates to ornamental crown moldings, and relates more particularly to elongated crown molding strips having outer surfaces with decorative ornamentation and side surfaces for engaging supporting walls, usually the ceiling and a vertical wall of a room space. The invention also relates to the method of making such strips, usually of plaster.

BACKGROUND OF THE INVENTION

It has long been the practice to use crown moldings to cover and decorate the junctures of room walls and ceilings, and to provide ornamentation on the exposed outer sides of the crown moldings as additional room decoration. Current examples of such crown moldings are shown in U.S. Pat. Nos. 5,433,048, 5,662,753 and 5,398,469, and older approaches are shown in U.S. Pat. Nos. 2,981,988, 3,201,910 and 3,481,092. It will be seen in these patents that there are numerous ways to design, manufacture and install crown moldings and a variety of different materials that may be used. As stated in the Loos patent, U.S. Pat. No. 5,662,753, the manufacture of ornamental molding made of plaster has required a relatively high skill level, either to run the molding "in place" on a wall or ceiling, or to cast the molding in elongated strips in stationary molds and then to mount the strips on the supporting room surfaces. It is generally accepted that plaster moldings, whether run-in-place or cast in stationary molds, are the richest looking and generally provide the most elegant appearance, but cost often leads to the use of cheaper substitutes.

Loos, for example, proposes the use of a relatively complex substitute for traditional plaster crown moldings, using a special base molding in an attempt to avoid the need for expensive production techniques and highly skilled labor. The other patents cited above provide other approaches for the same general purpose.

SUMMARY OF THE PRESENT INVENTION

The present invention resides in a novel construction for crown moldings that may be composed of plaster or similar molding materials and prefabricated at relatively low cost in elongated strips that are both ligher in weight and stronger in structure than prior plaster crown moldings, and that are specially designed and manufactured for easy installation by a single, unskilled installer. In other words, the crown molding strips of the present invention are particularly well suited for the do-it-yourself market, yet with highly desirable decorative ornamentation of the type previously available only in very expensive moldings.

More specifically, the crown molding strip of the present invention has an elongated body that may be composed primarily of conventional plaster, and an outside surface with raised, highly defined ornamentation of any selected design, and two layers in a novel combination of reinforcing fiber that makes it practical to provide the strips in thinner, lighter weight pieces that are not likely to break in shipment or when handled by one person during installation. One layer is bulk fiber, preferably fiberglass in bulk or "wool" form, and is mixed throughout the outer portion of the strip that carries the surface ornamentation. The second layer is a thin sheet of fabric, preferably fiberglass netting, that is approximately the same size as the crown molding strip and embedded in, and substantially coextensive with, the strip, with its edges close to the edges of the strip. This sheet cooperates with the bulk fiber to provide a high degree of strength in a thin, and very light weight, crown molding strip.

In addition, the preferred embodiment of the invention has corrugated side surfaces formed by patterns of grooves and ridges for engagement with the room surfaces, facilitating shaping of the side surfaces to accommodate irregularities in the room surfaces. These corrugations also enhance the attachment of the crown moldings with adhesives, providing increased bonding surface area and alleviating the need for precise measurement of the adhesive, and are of predetermined depth to serve as gauges for removal of material to fit bulges in the wall. Pre-formed nail-hole indentations may be provided in the strips at preselected nailing locations, facilitating nailing by a lone installer to secure each strip in place while the adhesive sets. These also may be formed by the installer at the site.

The novel method of the invention provides for the manufacture of crown molding strips according to the invention, as described in detail in the following detailed description, from which other features and advantages of the invention will become apparent.

DETAILED DESCRIPTION OF THE PREFERRED EMBODIMENT

Figure 1:
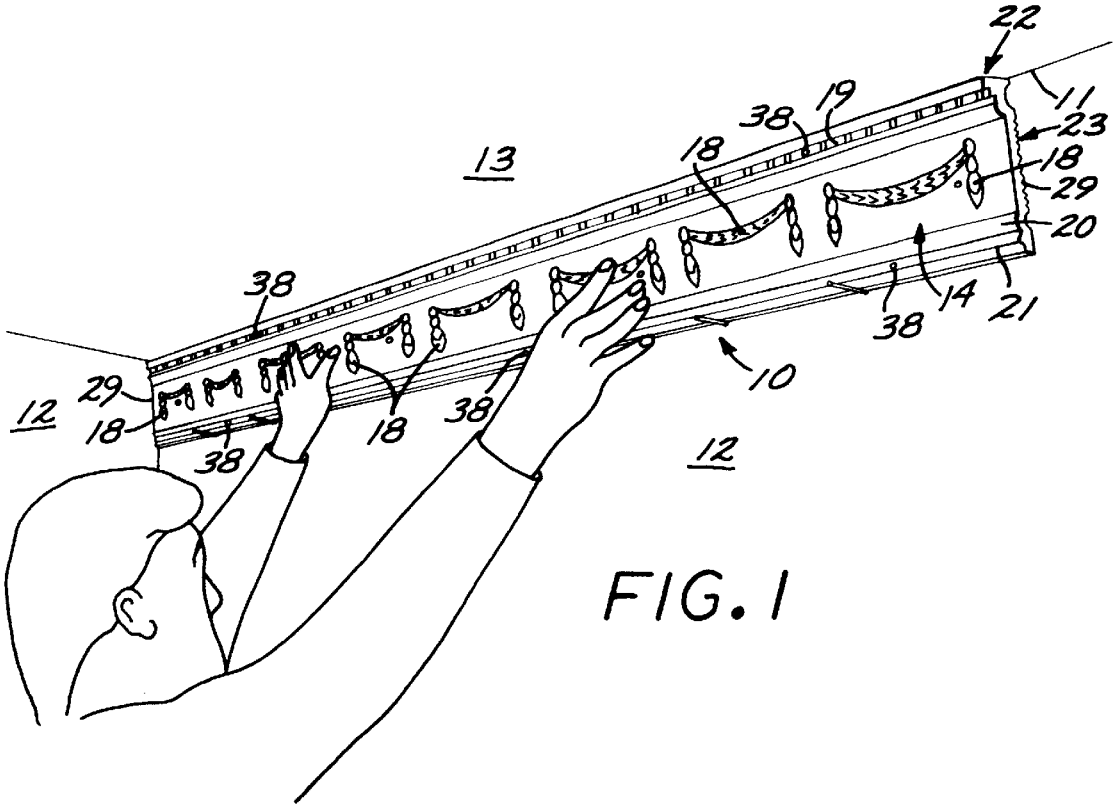
FIG. 1 is a fragmentary perspective view showing a person installing an ornamental crown molding strip constructed according to the present invention.
Figure 2:
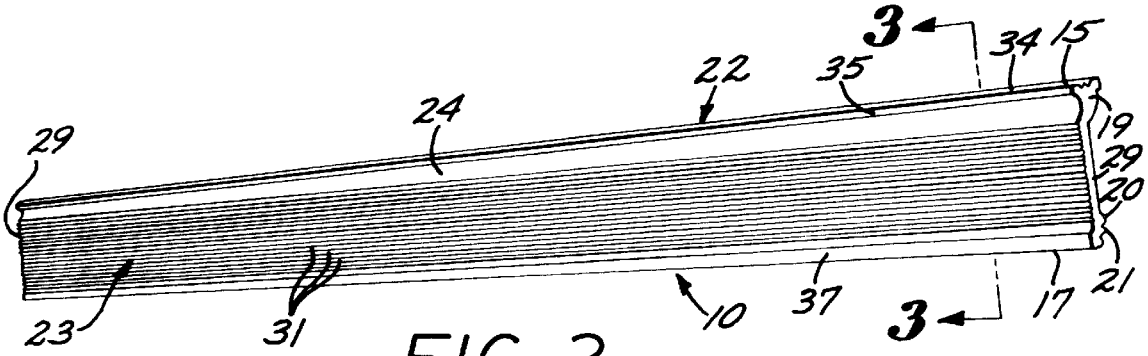
FIG. 2 is a somewhat enlarged rear perspective view taken from the inner side of the crown molding strip.
Figure 3:
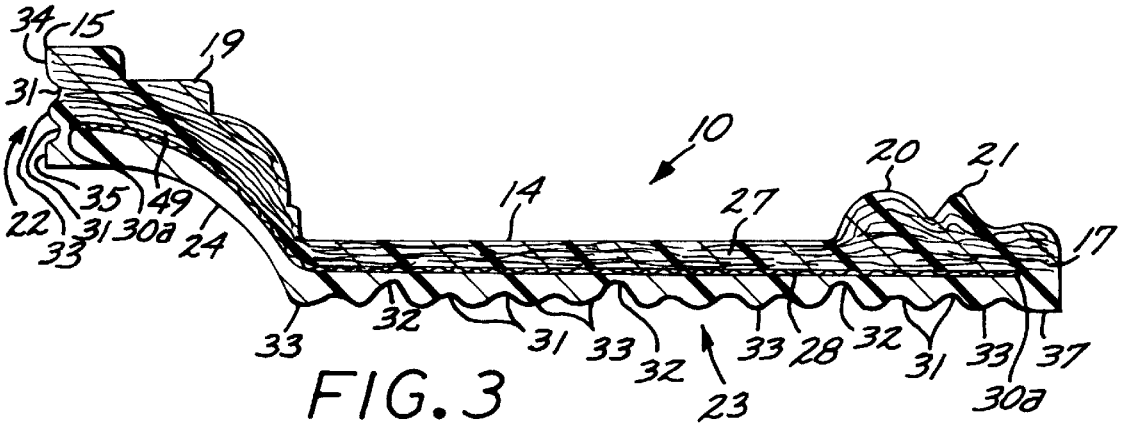
FIG. 3 is a further enlarged cross-sectional view taken along line 3—3 of FIG. 2.
Figure 4:
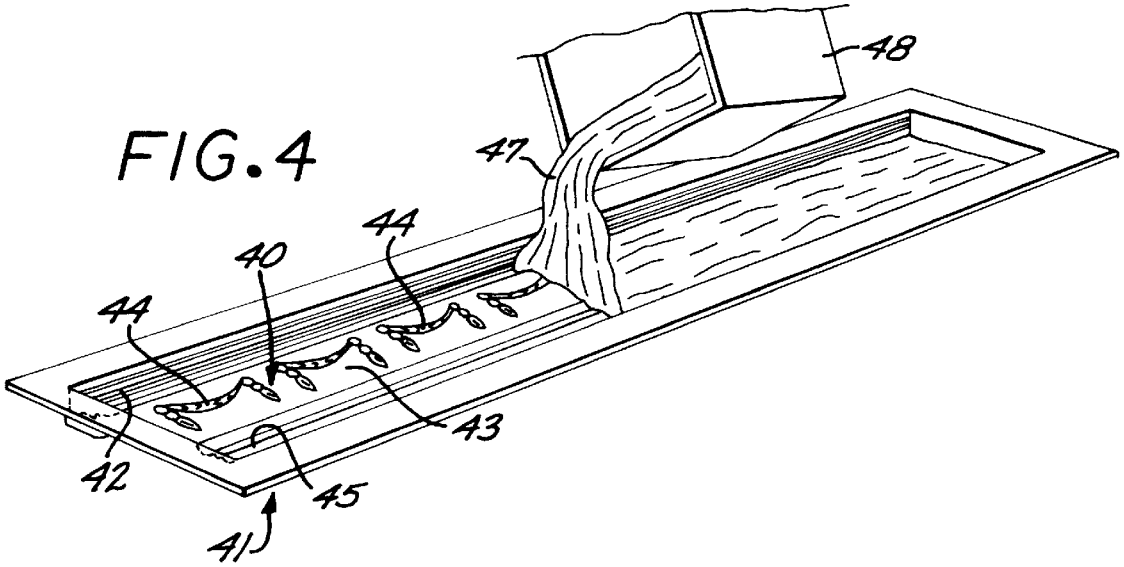
FIG. 4 is a perspective view of a production mold for use in the method of the invention, having a cavity into which plaster is being poured in the first pouring step of the method of the invention.

As shown in the drawings for purposes of illustration, the invention is embodied in an elongated ornamental crown molding strip, indicated generally by the reference number 10 and best seen in FIGS. 1 to 3. The strip 10 is intended for use as one of a series of such strips mounted end-to-end in a room space, usually to cover and decorate the juncture 11 between an upright wall 12 and a ceiling 13.

For this purpose, the strip 10 comprises generally an elongated body composed primarily of material that can be molded, preferably and traditionally of plaster, and formed with an outer decorative surface 14 for facing into the room and having generally parallel longitudinal edges 15 and 17. Formed on the outer surface are ornamental patterns, herein shown as raised garland-like designs 18 repeating along the central portion of the outer surface 14, a patterned cornice decoration 19 in a so-called "dental" design forming an upper border on the outer surface, and raised ridges 20 and 21 (see FIG. 3) extending along the lower edge 17.

The crown molding strip 10 also has two side surfaces, indicated generally at 22 and 23, for engagement with the ceiling 13 and the wall 12, the first of these being the top surface above the cornice decoration 19 and-the second being a laterally facing side surface spaced inwardly a preselected distance from the surface 14. Completing the strip 10 is an inner side 24 extending between the two side surfaces 22 and 23, herein a relatively short curved surface behind the cornice decoration 19. It should be understood that various designs may be used, and further that the laterally facing side surface 23 is shorter in many crown moldings, with outer decorative surfaces that are inclined upwardly away from the wall. Examples of such general configurations are shown in the aforesaid patents, but in types of construction that do not incorporate the present invention.

It will be evident to those skilled in the art that this general type of strip can be used to create a crown molding extending entirely around a room space, if desired. A plurality of strips 10 are arranged end-to-end along the walls, usually with miter joints (not shown) where two walls meet in a corner of a room, and are secured to the wall and ceiling by suitable fasteners and adhesives. A related application is being filed concurrently with this application for a patent on a preferred method of installation of crown moldings comprising strips of the type shown herein.

As previously mentioned, the material that is preferred by many for crown moldings is plaster, which has several advantages over wood and plastics, most notably the capability to be formed with more detailed ornamentation. Important disadvantages, however, have been high cost of time-consuming manufacture and installation by skilled craftsmen, as well as heavy weight and relatively high fragility. The present invention has the objective of making possible, and practical, relatively low cost plaster crown moldings that can be formed with a high degree of detailed ornamentation and, at the same time, being light in weight and durable so as to be installable by a single person, even as a do-it-yourself project.

To these ends, the present invention, as illustrated by the preferred embodiment disclosed herein, resides in an elongated and relatively thin (for plaster) crown molding strip 10 that has two layers 27 and 28 (FIG. 3) of reinforcing fiber that are combined in a novel manner to produce a lighter, more durable strip, and in which the side surfaces 22 and 23 are finished with a pattern of ribs and grooves that contribute significantly to the simplification of the installation process. One reinforcing layer 27 is bulk fiber, preferably fiberglass, that is intermixed throughout the outer portion of the strip 10, and the second layer 28 is a thin sheet of fabric, preferably fiberglass netting, that is embedded in the strip and substantially coextensive with the strip (see FIGS. 9 and 10). The bulk fiberglass provides both durability of the outer portion and surface of the strip and overall structural strength, and the fabric forms a generally central, strengthening spine for the strip. Optionally, additional small sheets of reinforcing fabric can be placed in selected areas, such as near each end in the strip along the surface 24. Together, these reinforcements impart sufficient strength to permit substantial reduction in thickness and weight of the strip, when cast of plaster, to as low as eight to fourteen millimeters, the preferred overall thickness (apart from ornamentation) being ten to eleven millimeters for optimum characteriestics.

As shown most clearly in FIG. 3, the bulk fiberglass 27 is intermixed in the outer layer of the strip 10 to a depth of approximately one-third to one-half of the thickness of the body, and into the raised ornamentation 18 to 21 as well, and the fabric 28 is centrally located, herein just to the outside of the center. The ends 30 (FIG. 9) of the fabric reinforcement 28 are close to the ends 29 of the strip 10, and the longitudinal edges 30*a* of the fabric are spaced a short distance from the edge 17 and side surface 22, as shown in FIG. 3.

The side surfaces 22 and 23 of the strip 10 are disposed generally in imaginary reference planes spaced ninety degrees apart, for substantially flat engagement with the wall 12 and the ceiling 13 as shown in FIG. 1. The illustrative molding strip has a narrow upper side surface 22 and a much wider vertical side surface 23, connected by a short arcuate inside surface 24. The pattern of ribs and grooves in each side surface is seen most clearly in FIG. 3, and herein runs longitudinally of the strip and covers virtually the full width and length of the strip. The preferred configuration is a regular wavy or corrugated pattern, but with different preselected depths of grooves 31 and 32. and with ribs 33 that lie on the same plane. In the illustrative embodiment, every fourth groove 32, from the right, is approximately double tie depth of the intervening grooves. In the illustrative strip 10, the shallow grooves 31 are about two millimeters deep and the deep grooves 32 are about four millimeters deep. It is to be noted that the fabric reinforcement 29 is spaced substantially more than four millimeters from the inner side edge 23. In view of its narrow width, the upper side edge 22 has only two shallow grooves 31.

These ribs and grooves serve several important purposes in the installation of the crown molding. First, when a bead (not shown) of fluid adhesive is applied wave-like to the surface that will engage the wall 12 or ceiling 13, the grooves 31, 32 provide spaces for receiving excess adhesive and confining it against the strip 10, thus reducing the tendency of the adhesive to leak away from the strip. Flats at 34, 35 and 37, along the margins of the side surfaces 22 and 23 tend to seal against the wall and the ceiling. In addition, improved holding by the adhesive results from the increased surface area covered by the adhesive, and also by the increased thickness of the layer of adhesive in the grooves.

Another important function of the ribs and grooves during installation is facilitating the removal of plaster in selected areas of the side surfaces 22 and 23 to fit over low spots (not shown) in the ceiling 13 or bulges (not shown) in the wall 12 in the area to be covered by the crown molding. Using a hand tool such as a rasp (not shown), the installer can shave away part of the plaster of the ribs 33, to a selected depth that can be roughly gauged by reference to the known depth of the grooves 31 and 32. Grooved plaster is very easily shaped in this way to fit properly against the supporting surface.

An optional feature of the molded strip 10 is the provision of pre-formed nail holes 38 in selected nailing locations along the strip. These facilitate the starting of nails, which can be fairly difficult to do for one person holding a strip in place against the ceiling. The primary purpose of the nails, of course, is to hold the strip in place until the adhesive sets, and thereafter to reinforce the adhesive. The nail holes also can be formed by the installer at the work site, using a drill or other suitable tool.

While reference has been made, throughout this description, to aspects of the steps that make up the method of making the crown molding strip 10, a step-by-step explanation now will be given with reference to FIGS. 4 through 15 of the drawings. First, an open-sided mold cavity 40 is provided in a generally flat mold 41 having one side 42 that is shaped to form the grooved side surface 22 of the strip 10, a generally flat bottom wall 43 (FIG. 4) formed with indentations 44 for forming the garland ornamentation 18, and a second side 45 that forms the strip's lower edge 17. The illustrative cavity 40 is at least ten to eleven millimeters deep, for molding of strips 10 of that thickness, and has detailed shapes for molding all of the details of the strip 10, other than the inwardly facing portions. The length of the strip may be varied, but a length of six and one-half feet is preferred, for ease of shipment and also for ease in handling during installation.

Figure 5:
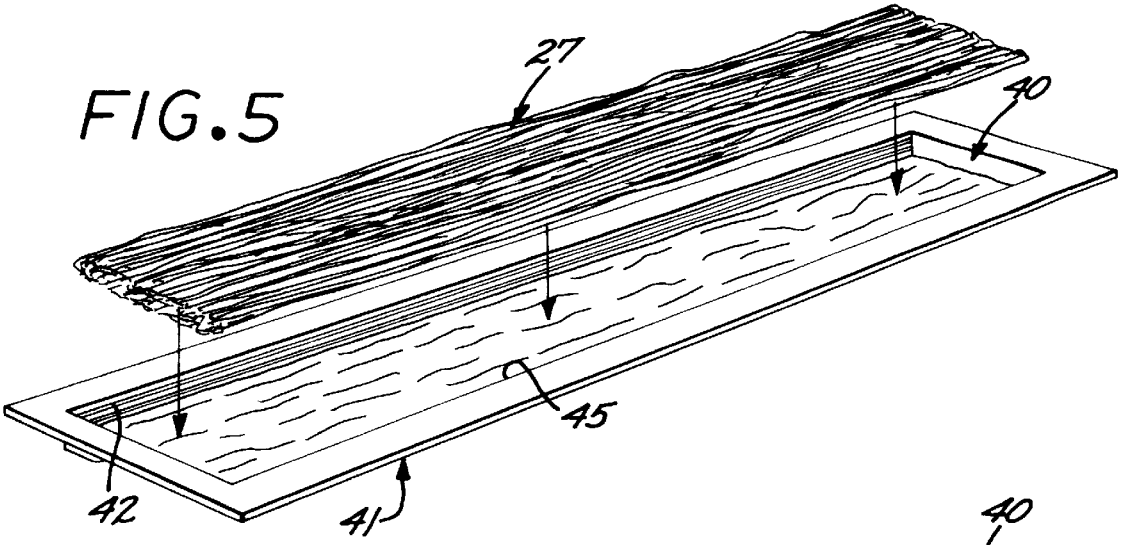
FIG. 5 is a perspective view similar to FIG. 4 showing the beginning of a subsequent step of mixing into the first layer a predetermined quantity of bulk fibers.
Figure 6:
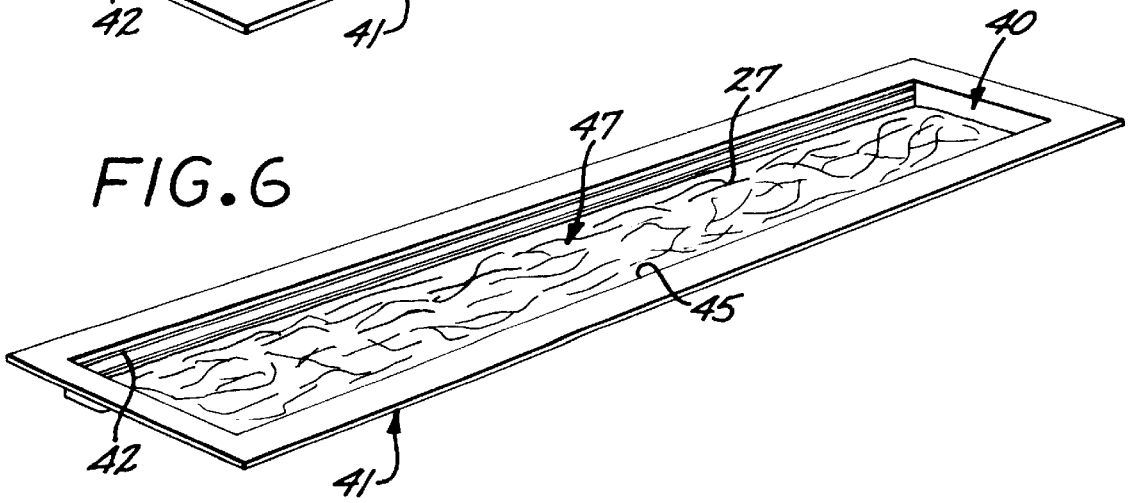
FIG. 6 is a perspective view similar to FIG. 5 after the bulk fibers have been intermixed with the plaster.
Figure 7:
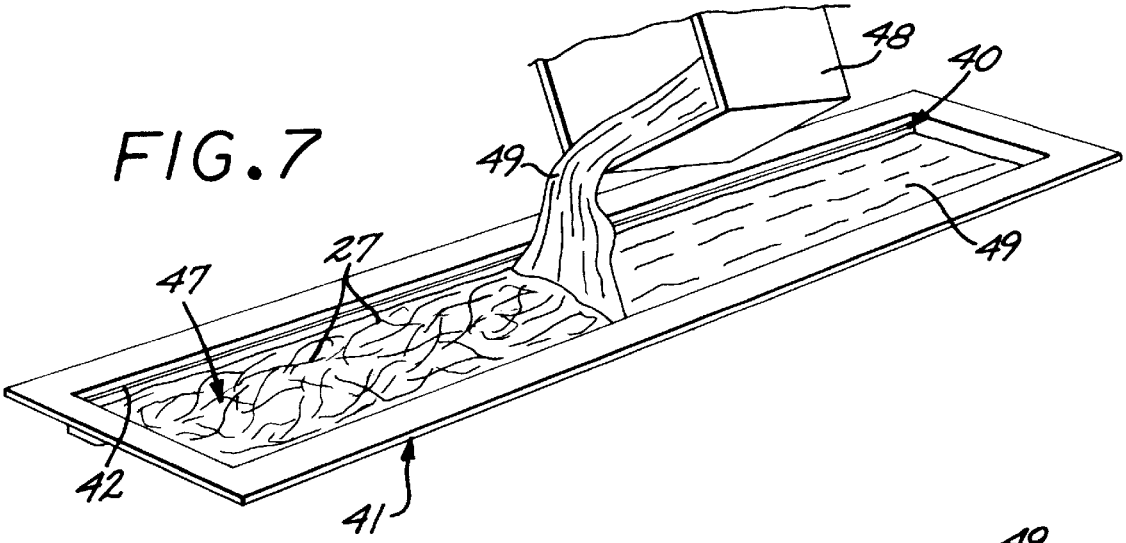
FIG. 7 is a perspective view similar to FIG. 6 showing the pouring of a second layer of plaster into the mold cavity.
Figure 8:
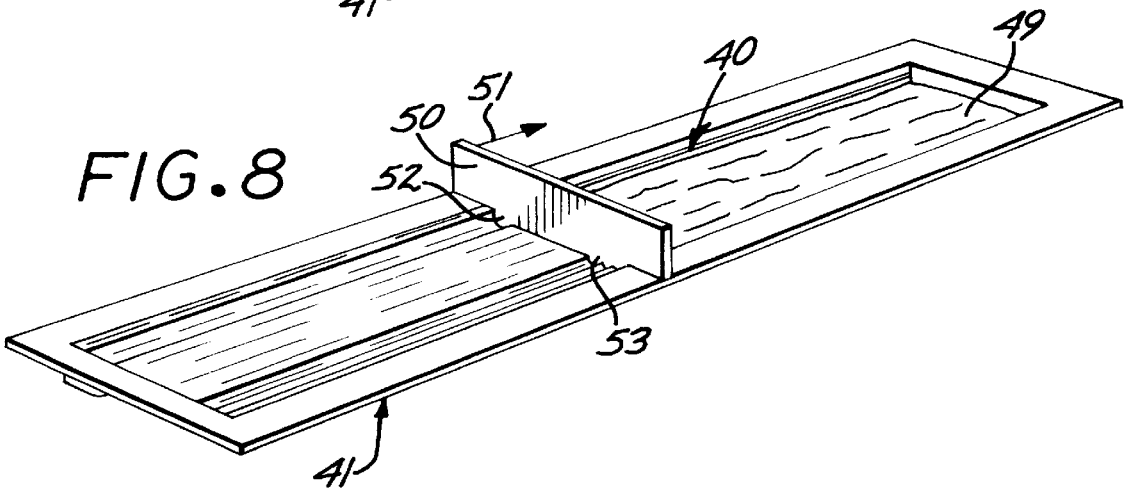
FIG. 8 is a perspective view similar to FIG. 7 showing the leveling of the second layer.

Into this mold cavity 40, a preselected quantity of plaster 47 is poured in fluid state from a container 48, the amount being sufficient to fill the indentations 44 and cover the bottom wall 43 to the first preselected depth, herein about two millimeters. At this point, a preselected quantity of bulk reinforcing fiber 27, preferably bulk fiberglass or fiberglass "wool", is placed in the mold and then intermixed with the plaster of the first pour. These steps are shown in FIGS. 5 and 6, the latter showing the plaster 47 generally leveled with the bulk fiber 27 mixed in.

Next, a second pour 49 (FIG. 7) of plaster in fluid state is made from a container 48, this time with a preselected amount sufficient to form an intermediate layer of plaster on top of the first layer that will form the outer portion of the strip 10. The preferred thickness of this layer is approximately two to three millimeters, bringing the mold cavity 40 to about one-half full. Preferably this layer 49 is leveled to a fairly even exposed surface by drawing a template 50 over the exposed surface as indicated by the arrow 51. The template has shaping portions 52 and 53 which begin forming the shape of the inner side of the strip 10, as shown.

Figure 9:
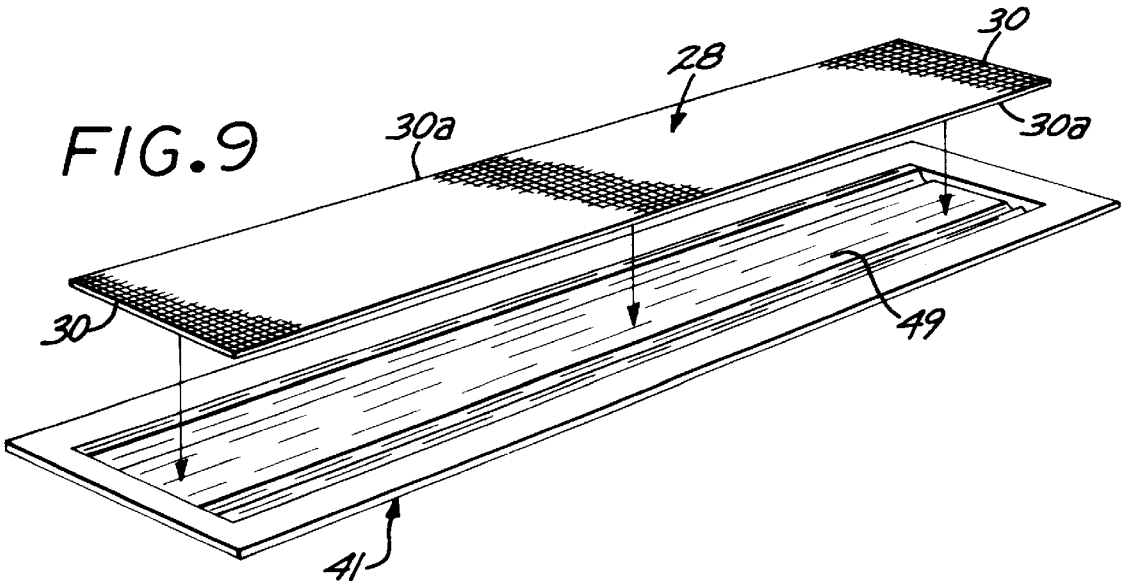
FIG. 9 is a perspective view similar to FIG. 8 with the further layer leveled and showing the application of a sheet of reinforcing fabric.
Figure 10:
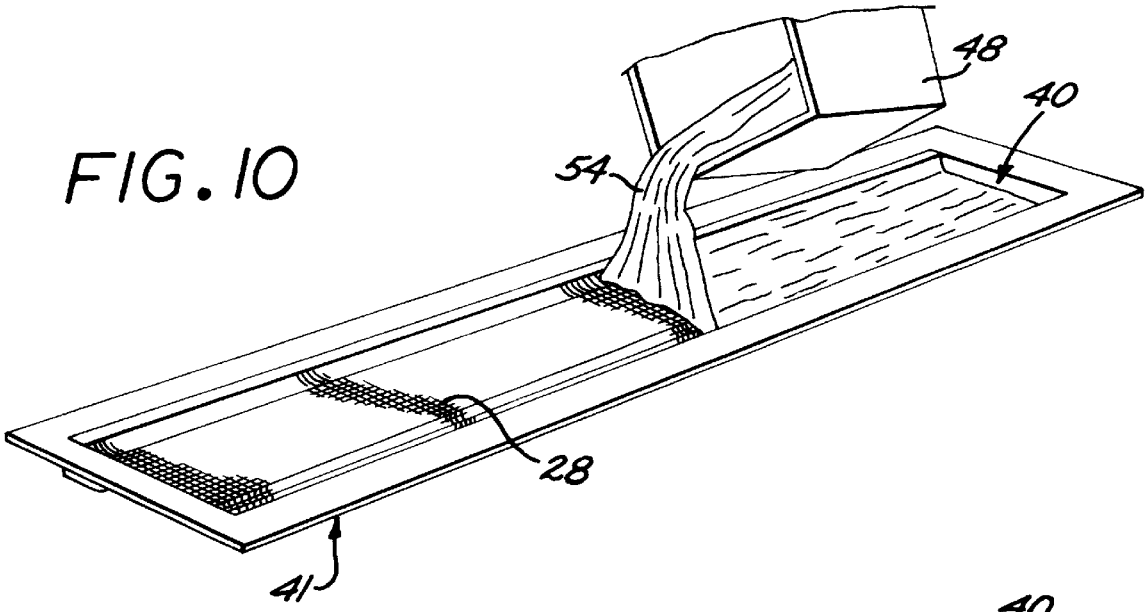
FIG. 10 is a perspective view similar to FIG. 9 showing the pouring of a further layer of plaster in the mold cavity over the reinforcing fabric.

The fabric reinforcement 28 now is applied to the leveled surface of the layer 49 (see FIG. 9). The preferred fabric is a sheet of fiberglass netting with a fairly large mesh size, on the order of three-sixteenths of an inch, so as to be easily spread and pressed into the surface of the plaster, with the edges 30*a*, 30 of the fabric close to the sides and ends of the mold.

Figure 11:
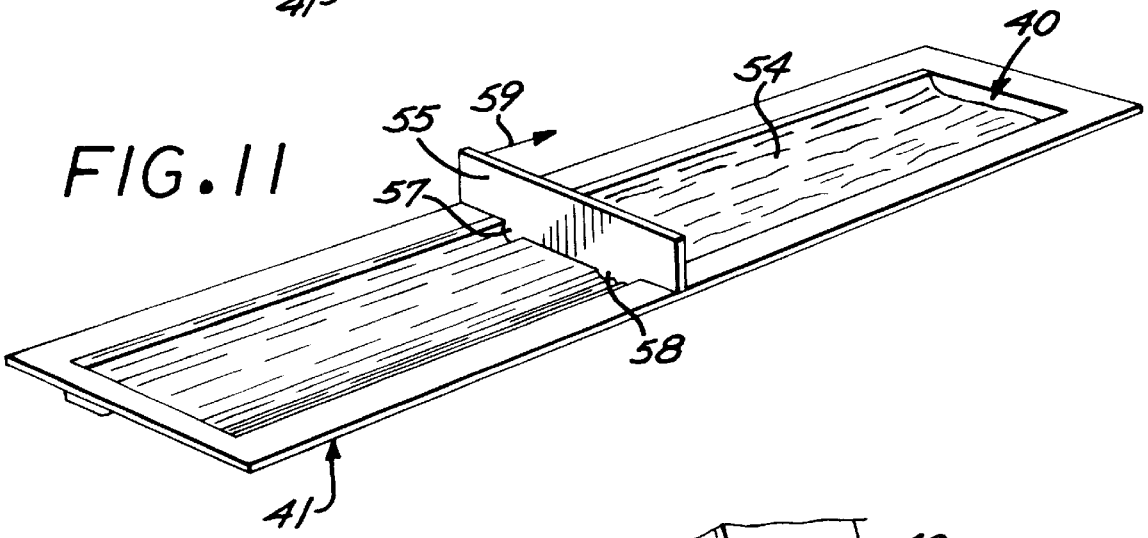
FIG. 11 is a perspective view showing the leveling of the further layer of plaster.
Figure 12:
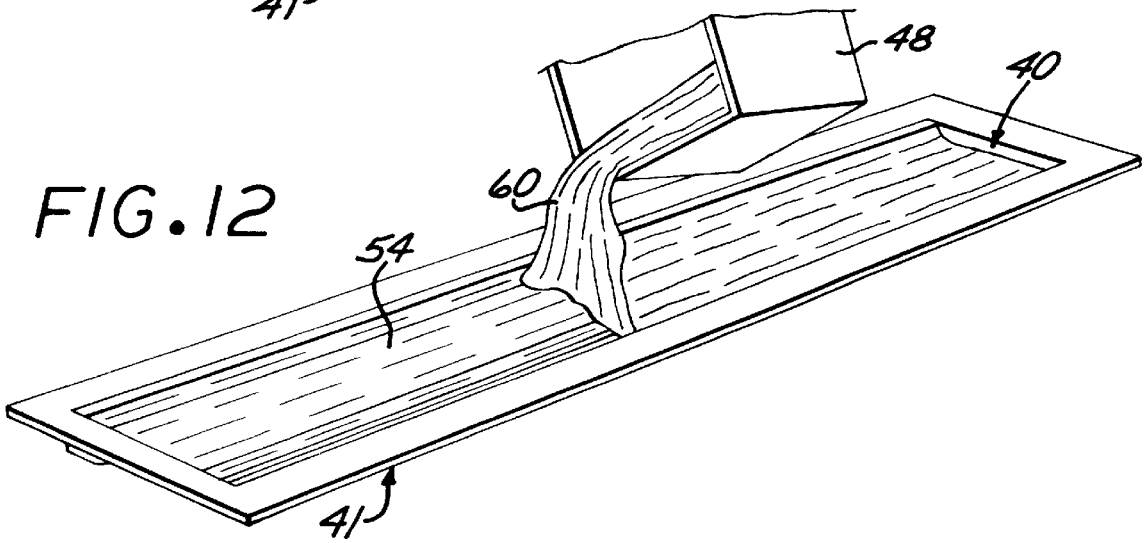
FIG. 12 is a perspective view showing the pouring of a fourth layer of plaster into the mold cavity.
Figure 13:
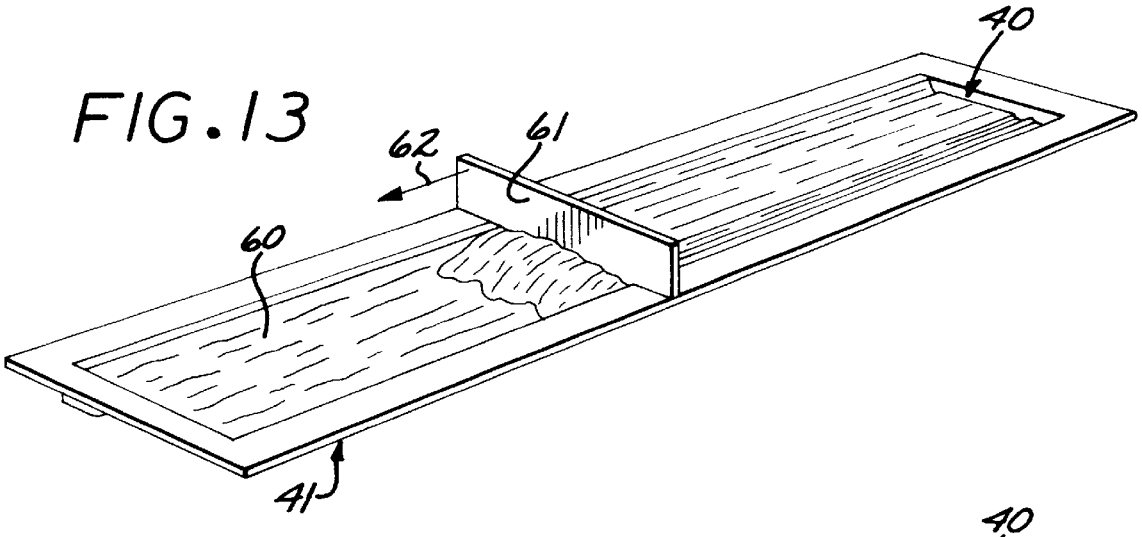
FIG. 13 is a perspective view showing the leveling of the fourth layer of plaster in the mold.
Figure 14:
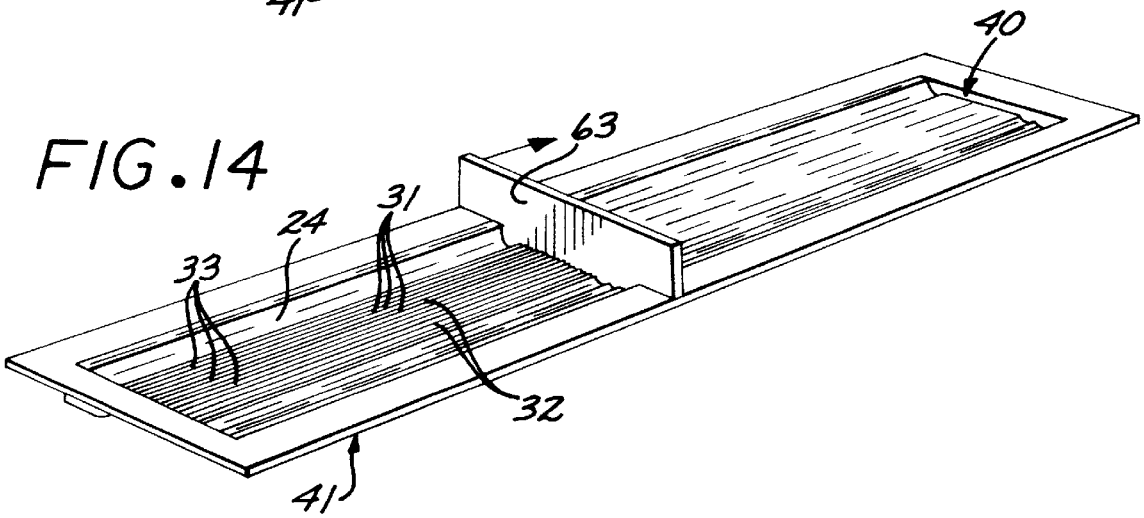
FIGS. 14 and 15 are perspective views similar to FIG. 13 showing the steps of forming and finishing a pattern of grooves and ridges in the exposed surface of the plaster in the mold.

With the fabric netting 28 in place, a further pour 54 of fluid plaster is made from a container 48 (FIG. 10), this time with a preselected quantity sufficient to bring the thickness of the illustrative strip 10 to six to seven millimeters. This plaster is levelled in the mold cavity 40 as shown in FIG. 11, with a shaping template 55 having shaping portions 57 and 58 for the inner side, and moved in the direction of the arrow 59. This is an opportune time for applying additional small pieces of fabric netting (not shown) near the ends of the strip, for example, a four-inch wide piece embedded about one inch from each end, and lying in the curved part of the strip. Another pour 60 preferably is made to complete the filling of the cavity 40 (see FIG. 12), usually with an excess of plaster that is scraped off in the last leveling step with a template 61, moved in the direction of the arrow 62 in FIG. 13.

Figure 15:
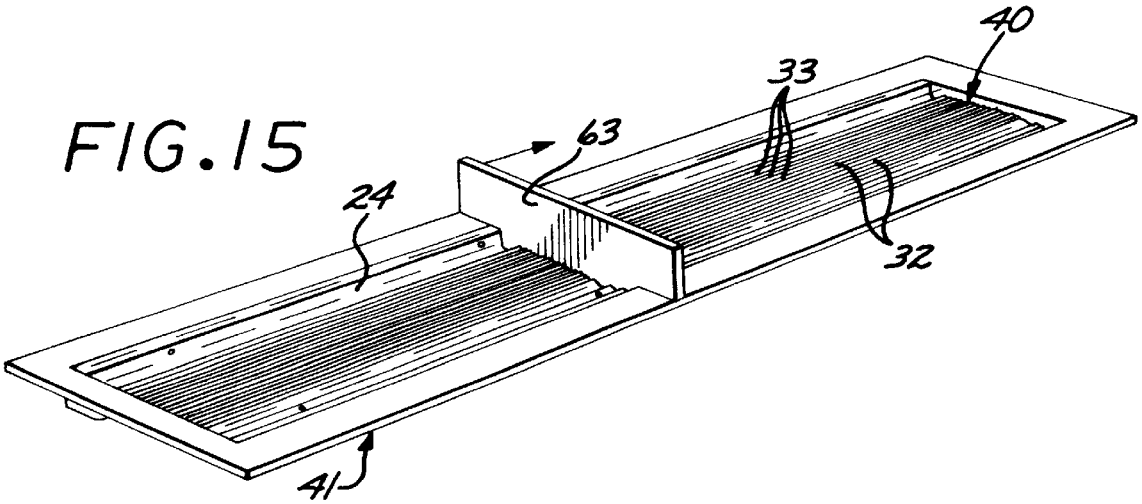

The finishing of the exposed surface of the plaster in the mold, to form the side surface 23 and the inside 24 of the strip 10, should be delayed until just before the plaster hardens. This preferably is done in two or more passes over the surface, the first shown in FIG. 14 with a detailing template 63 that forms the ribs 33 and grooves 31, 32 while finishing the surface. A second finishing pass is shown in FIG. 15, to smooth the finish of the exposed plaster. After completion, the plaster is allowed to set before removal from the mold. The mold is of the reusable type, and a production line of multiple molds for each casting worker or team is the usual practice in mass-production of such strips.

From the foregoing, it will be apparent that the present invention makes possible the production of crown molding strips 10 from traditional plaster in a manner that provides a relatively lightweight and strong strip that can be mass-produced at low cost and can be installed with relative ease by a single unskilled installer. It also will be evident that, while one currently preferred embodiment has been illustrated and described, various modifications and changes may be made by those skilled in the art without departing from the spirit and scope of the invention.

I claim as my invention:

1. A prefabricated ornamental plaster crown molding strip for installation in a room space along the juncture of a ceiling and a wall, said strip comprising:

an elongated body composed primarily of plaster and having:

an outer decorative surface for facing into the room space and including raised decorative ornamentation thereon, said decorative surface having first and second edges for extending, respectively, along the ceiling and the wall, first and second side edge surfaces for engagement with the ceiling and the wall, respectively, one longitudinal edge portion of said body being offset to form a cornice along one edge of the body, and an inside surface substantially parallel to the outer surface and extending between said side edge surfaces, said body being of a predetermined thickness along its length between said outer surface and said inside and side edge surfaces, apart from said raised ornamentation;

a first reinforcing layer of lightweight fabric in the form of netting embedded in said plaster in predetermined spaced relation with said outer surface and with said inside and side surfaces, said netting having side edges close to the side edges of said outer surface;

and a second reinforcing layer of lightweight non-woven, long-fiber material intermixed throughout the outer portion of the plaster between said netting and said decorative surface;

said first and second side surfaces comprising patterns of alternating longitudinal grooves and ridges, the grooves being of preselected depths less than the spacing of said first reinforcing layer from said first and second side surfaces.

2. A prefabricated ornamental plaster crown molding strip as defined in claim 1 wherein said first and second reinforcing layers are fiberglass netting and bulk fiberglass, respectively.

3. A prefabricated ornamental plaster crown molding strip as defined in claim 1 wherein said patterns of grooves and ridges cover said first and second side surfaces except for said one longitudinal edge portion, said ridges comprising unreinforced plaster.

4. A prefabricated ornamental plaster crown molding strip as defined in claim 3 wherein said patterns comprise spaced first grooves of preselected depth and second grooves shallower than said preselected depth.

5. A prefabricated ornamental plaster crown molding strip as defined in claim 3 wherein said predetermined thickness of said body is in the range of eight to thirteen millimeters, and said first reinforcing layer is spaced from said outer surface in the range of approximately one-half to two-thirds of the thickness of the body.

6. A prefabricated ornamental plaster crown molding strip as defined in claim 3 wherein said predetermined thickness is approximately eleven millimeters and said first reinforcing layer is spaced from said outer surface approximately seven millimeters and from the remaining surfaces by approximately four millimeters.

7. A prefabricated ornamental plaster crown molding strip as defined in claim 6 wherein said first grooves are of a maximum depth in the range of one to three millimeters.

8. A prefabricated ornamental plaster crown molding strip as defined in claim 7 wherein said first and second grooves are of varied depth ranging from less than one millimeter to more than two millimeters.

9. A prefabricated ornamental plaster crown molding strip as defined in claim 1 further including preformed nail-hole indentations in selected nailing locations in said outer surface.

10. A prefabricated ornamental plaster crown molding strip for installation in a room space along the juncture of a ceiling and a wall, said strip comprising:

an elongated body composed primarily of plaster and having:

an outer decorative surface for facing into the room space and including raised decorative ornamentation thereon, said decorative surface having first and second edges for extending, respectively, along the ceiling and the wall, first and second side surfaces substantially parallel to said outer surface for engagement with the ceiling and the wall, respectively, and an inside surface extending between said side surfaces, said body being of a predetermined uniform thickness between said outer surface and said inside and side surfaces, apart from said raised ornamentation and having one longitudinal edge portion that is offset to form a cornice;

a first reinforcing layer of lightweight open mesh fabric embedded in said plaster in predetermined spaced relation with said outer surface and with said inside and side surfaces, said fabric having side edges close to the side edges of said outer surface;

and a second reinforcing layer of lightweight non-woven, fiber material intermixed throughout the outer portion of the plaster between said fabric and said decorative surface.

11. A prefabricated ornamental plaster crown molding strip as defined in claim 10 further including a layer of unreinforced plaster between said first and second reinforcing layers, said fabric being embedded in said layer of plaster.

12. A prefabricated ornamental plaster crown molding strip as defined in claim 10 wherein said predetermined uniform thickness of said body is in the range of eight to thirteen millimeters, and said first reinforcing layer is spaced from said outer surface in the range of one-half to two thirds of the thickness of the body.

13. A prefabricated ornamental plaster crown molding strip as defined in claim 10 wherein said thickness is approximately eleven millimeters and said first reinforcing layer is spaced from said outer surface approximately seven millimeters and from the remaining surfaces by approximately four millimeters.

14. A prefabricated ornamental plaster crown molding strip as defined in claim 10 wherein said first and second side surfaces comprise patterns of alternating grooves and ridges, the grooves being of preselected depths less than the spacing of said first reinforcing layer from said first and second side surfaces.

15. A prefabricated ornamental plaster crown molding strip as defined in claim 10 wherein said fabric is fiberglass netting and said long-fiber material is bulk fiberglass.

16. A prefabricted ornamental plaster crown molding strip as defined in claim 10 further including preformed nail-hole indentations in selected nailing locations in said outer surface.

17. In a prefabricated molded ornamental strip of predetermined length, thickness and width having an outer surface including raised decorative ornamentation thereon, and first and second side surfaces for engagement with angularly disposed supporting surfaces, the improvement comprising:

first and second layers of fiber reinforcement embedded in the strip, the first layer being a sheet of open mesh fabric slightly narrower in width than the strip and positioned a predetermined distance inwardly from said outer surface, and said second layer being non-woven bulk fibers intermixed in the outer portion of the strip between the first layer and said outside surface.

18. The improvement defined in claim 17 wherein said first and second reinforcing layers are fiberglass netting and bulk fiberglass, respectively.

19. The improvement defined in claim 18 wherein said strip has at least one side surface formed with a pattern of spaced first grooves of preselected depth with bottoms close to said first reinforcing layer and separated by a plurality of second grooves of a different preselected depth between each pair of first grooves.

20. The improvement defined in claim 17 further including preformed nail-hole indentations in selected nailing locations in said outer surface.

21. A prefabricated ornamental plaster crown molding strip for installation in a room space between a wall and a ceiling, comprising an elongated body composed primarily of plaster and having:

an outer decorative surface for facing into the room space and including raised decorative ornamentation integrally joined to the body;

an inside surface parallel to said outside surface for facing the wall, said elongated body being of uniform thickness, apart from said ornamentation, along its length, and a patterned cornice decoration integral with the remainder of the body extending along one edge portion of the body and having an upper edge for engaging the ceiling, said cornice decoration being offset from the remainder of the body to extend into the room space, and being of the same thickness as the remainder of the body;

a first reinforcing layer of open-mesh fabric embedded in the body and in said cornice and having side edges close to the edges of the body, said fabric being spaced from said inside and outside surfaces;

and a second reinforcing layer of non-woven fiber material intermixed in the plaster between said fabric and said outside surface to reinforce the outer portion of the body adjacent said outside surface.

22. A prefabricated ornamental crown molding strip as defined in claim 21 wherein said inside surface comprises a pattern of alternating longitudinal grooves and ridges.

23. A prefabricated ornamental crown molding strip as defined in claim 21 wherein the thickness of said body is in the range of eight to thirteen millimeters, and said first layer is spaced from the outside surface by one-half to two-thirds the thickness.

24. A prefabricated ornamental crown molding strip as defined in claim 21 wherein said cornice decoration has a concave curvature on its inner side forming the offset from the remainder of the body, and a flat upper edge for engagement with the ceiling.

25. A prefabricated ornamental crown molding strip as defined in claim 21 wherein said decorative cornice has a concavely curved inner side, a decorated outside surface following the curvature of said inner surface, and a flat upper edge, said first and second layers extending into said decorative cornice.

* * * * *